US007189195B1

(12) United States Patent
Chuang

(10) Patent No.: US 7,189,195 B1
(45) Date of Patent: Mar. 13, 2007

(54) CORRUGATED SHEET FORMING UNIT OF A CORRUGATED SHEET MATERIAL MAKING MACHINE

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 35 days.

(21) Appl. No.: 11/158,087

(22) Filed: Jun. 22, 2005

(51) Int. Cl.
*B31F 1/20* (2006.01)

(52) U.S. Cl. ..... 493/463; 72/181; 72/454

(58) Field of Classification Search ..... 493/395, 493/463; 72/181, 178, 449, 450, 454
See application file for complete search history.

(56) References Cited

U.S. PATENT DOCUMENTS 2,471,490 A * 5/1949 Mercer ..... 72/178
3,628,361 A * 12/1971 De Rupa ..... 72/181
4,087,226 A * 5/1978 Mercer ..... 425/397
4,412,443 A * 11/1983 Stoehr ..... 72/181
4,969,346 A * 11/1990 Bosl et al. ..... 72/177
7,040,001 B1 * 5/2006 Chuang ..... 29/564
7,096,702 B2 * 8/2006 McDonald ..... 72/181

* cited by examiner

*Primary Examiner*—Louis K. Huynh
*Assistant Examiner*—Thanh Truong
(74) *Attorney, Agent, or Firm*—Troxell Law Office, PLLC

(57) ABSTRACT

A corrugated sheet forming unit used in a corrugated sheet material making machine for processing a metal sheet material into a corrugated sheet is disclosed to include a table vertically movable to fit the elevation of the conveyer and receiving unit of the machine and to carry first shape forming roller sets or second shape forming roller sets into the working position for processing the supplied sheet material into a corrugated sheet of a first pattern or a corrugated sheet of a second pattern selectively.

2 Claims, 15 Drawing Sheets

CORRUGATED SHEET FORMING UNIT OF A CORRUGATED SHEET MATERIAL MAKING MACHINE

BACKGROUND AND SUMMARY OF THE INVENTION

The present invention relates to a corrugated sheet material making machine and more particularly, to a corrugated sheet forming unit for use in a corrugated sheet material making machine to process a plain metal sheet material into a corrugated sheet of a first pattern or a corrugated sheet of a second pattern selectively.

FIG. 1 shows a corrugated sheet material making machine 8 according to the prior art. According to this design, sheet material 811 is supplied from a feeder 81 and conveyed to a corrugated sheet forming unit 83 by a conveyer 82 for processing into a corrugated sheet, which is then cut into finished products by a cut-off unit 84 and then collected by a receiving unit 85 for further packing and storage. The corrugated sheet forming unit 83 comprises a plurality of roller holders 831 each holding a shape forming roller set 830. The shape forming roller set 830 comprises an upper roller shaft 8301, an upper shape forming roller (not shown) mounted on the upper roller shaft 8301, a lower roller shaft 8302, and a lower shape forming roller (not shown) mounted on the lower roller shaft 8302. The corrugated sheet forming unit 83 of this design of corrugated sheet material making machine can only process a plain sheet material into one particular pattern of corrugated sheet. For making another pattern of corrugated sheet, a different corrugated sheet forming unit shall be used with the corrugated sheet material making machine. However, it is inconvenient to change the corrugated sheet forming unit. When a different corrugated sheet forming unit is used, the operator must adjust the elevation of the new corrugated sheet forming unit to match the elevation of the feeder and the conveyer.

The present invention has been accomplished under the circumstances in view. It is therefore one object of the present invention to provide a corrugated sheet forming unit for corrugated sheet material making machine, which is practical for processing a plain metal sheet material into a corrugated sheet of a first pattern or a corrugated sheet of a second pattern selectively.

According to one aspect of the present invention, the table of the corrugated sheet forming unit is vertically movable so that the operator can select first shape forming roller sets or second shape forming roller sets to process the supplied plain sheet material to the desired corrugated sheet, i.e., the corrugated sheet forming unit is practical for processing plain metal sheets into two different shapes of corrugated sheets.

According to another aspect of the present invention, the table of the corrugated sheet forming unit is vertically movable to fit the elevation of the conveyer and receiving unit of the corrugated sheet material making machine.

According to still another aspect of the present invention, the roller holders of the corrugated sheet forming unit each support at least one first shape forming roller set and one second shape forming roller set for processing plain sheet materials into different shapes of corrugated sheets, saving much factory space.

DETAILED DESCRIPTION OF THE INVENTION

Figure 1:
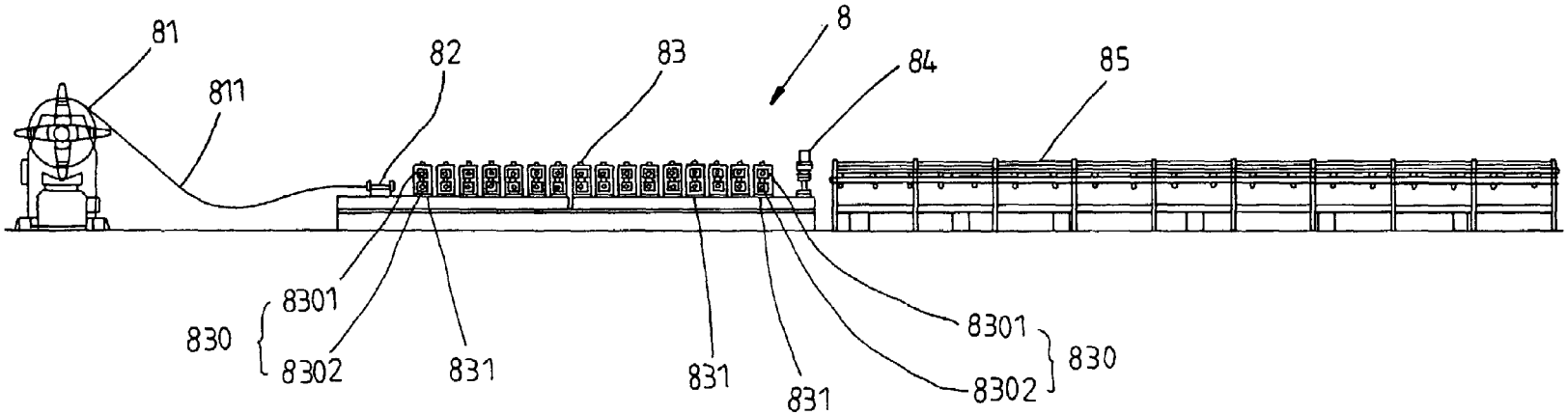
Fig.1 PRIOR ART
FIG. 1 is side plain view of a corrugated sheet material making machine according to the prior art.
Figure 2:
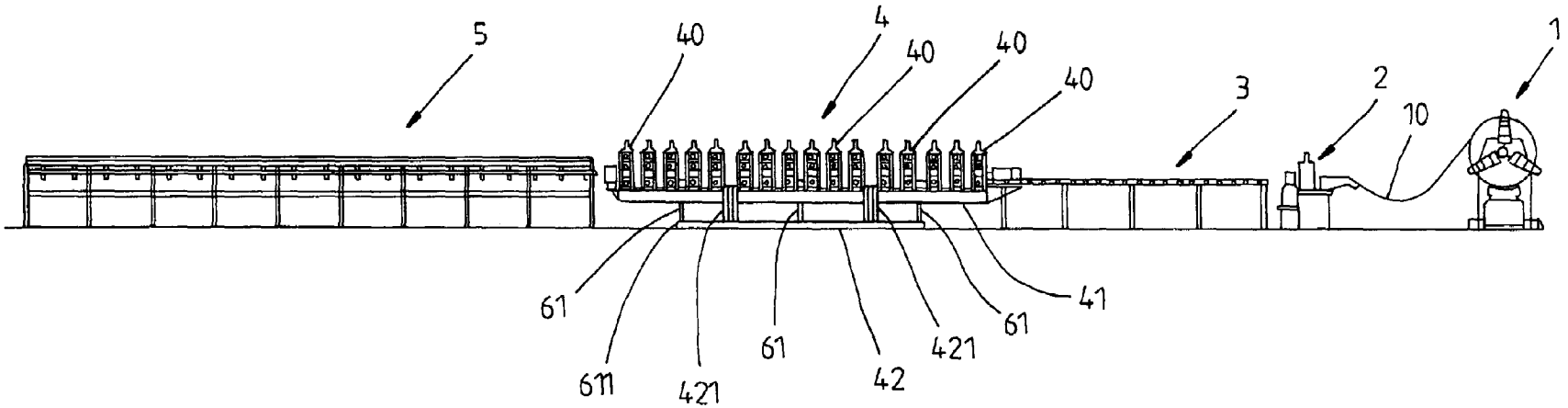
FIG. 2 is side plain view of a corrugated sheet material making machine according to the present invention.
Figure 3:
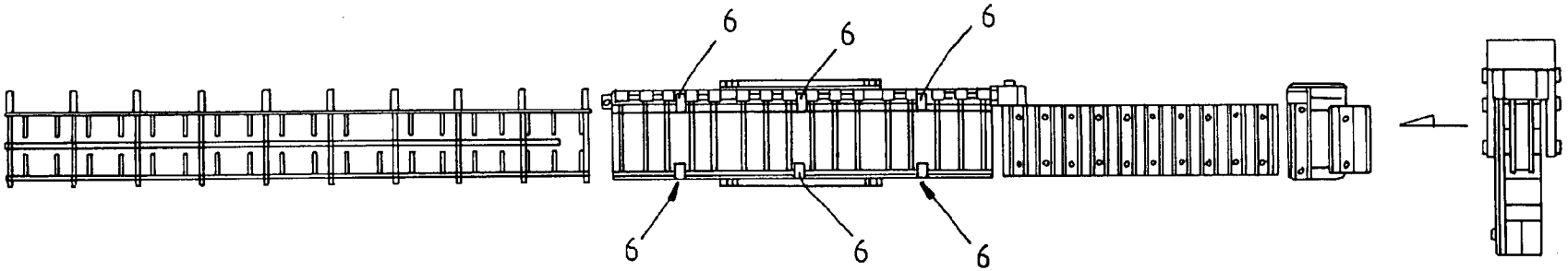
FIG. 3 is a top plain view of the corrugated sheet material making machine according to the present invention.
Figure 4:
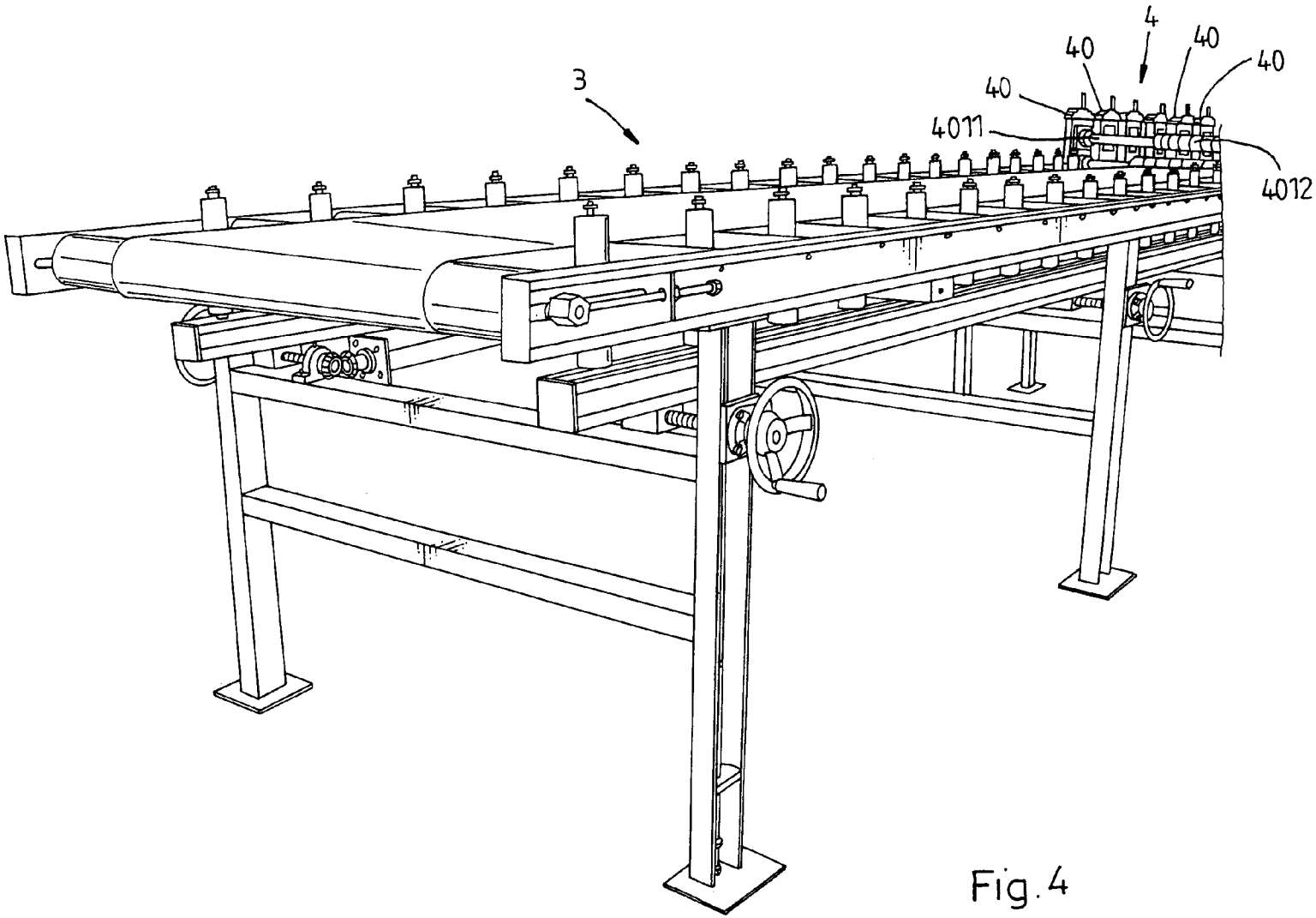
FIG. 4 is a perspective view in an enlarged scale of a part of FIG. 3, showing the structure of the conveyer and the corrugated sheet forming unit.
Figure 5:
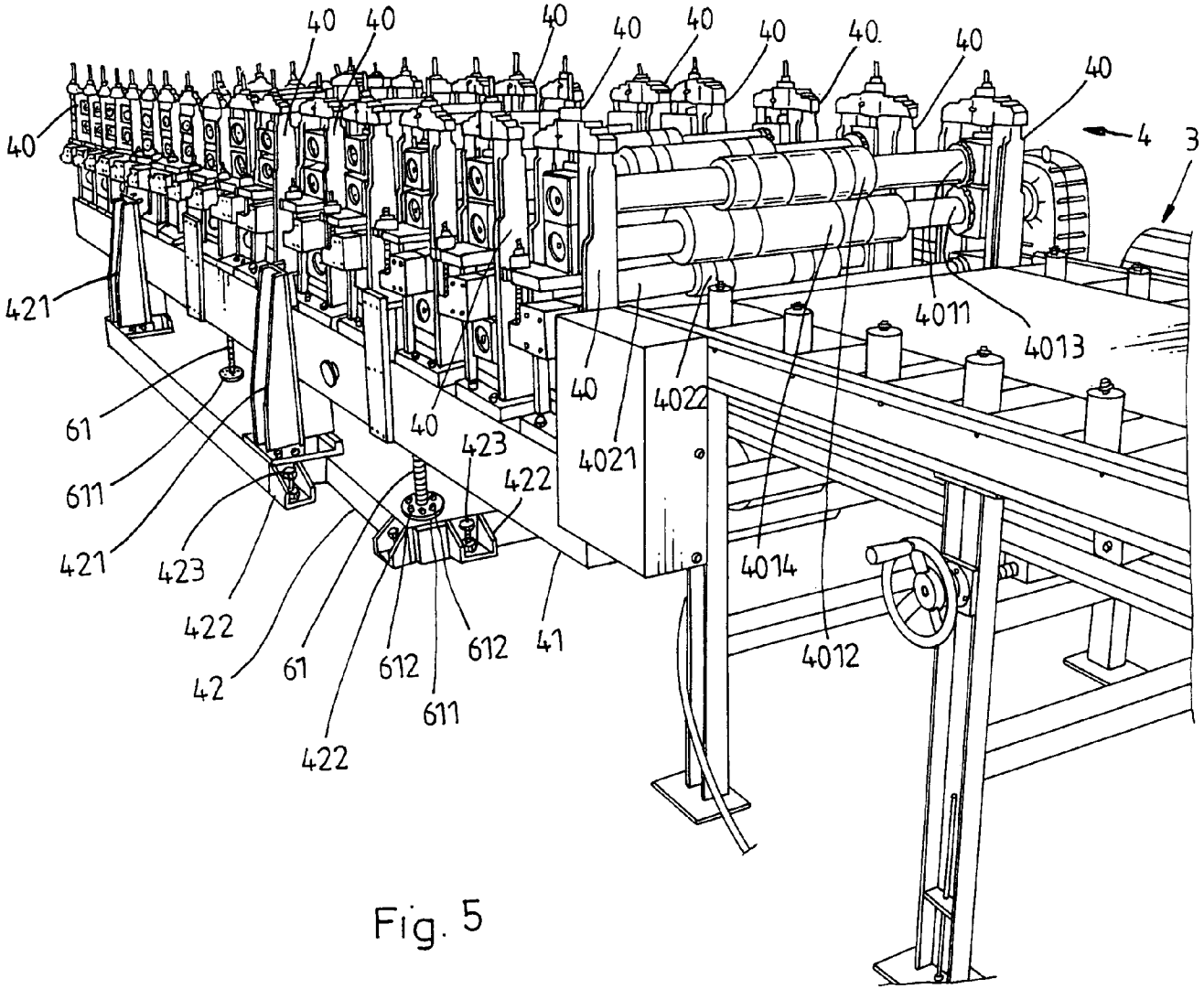
FIG. 5 corresponds to FIG. 4 when viewed from another angle.
Figure 6:
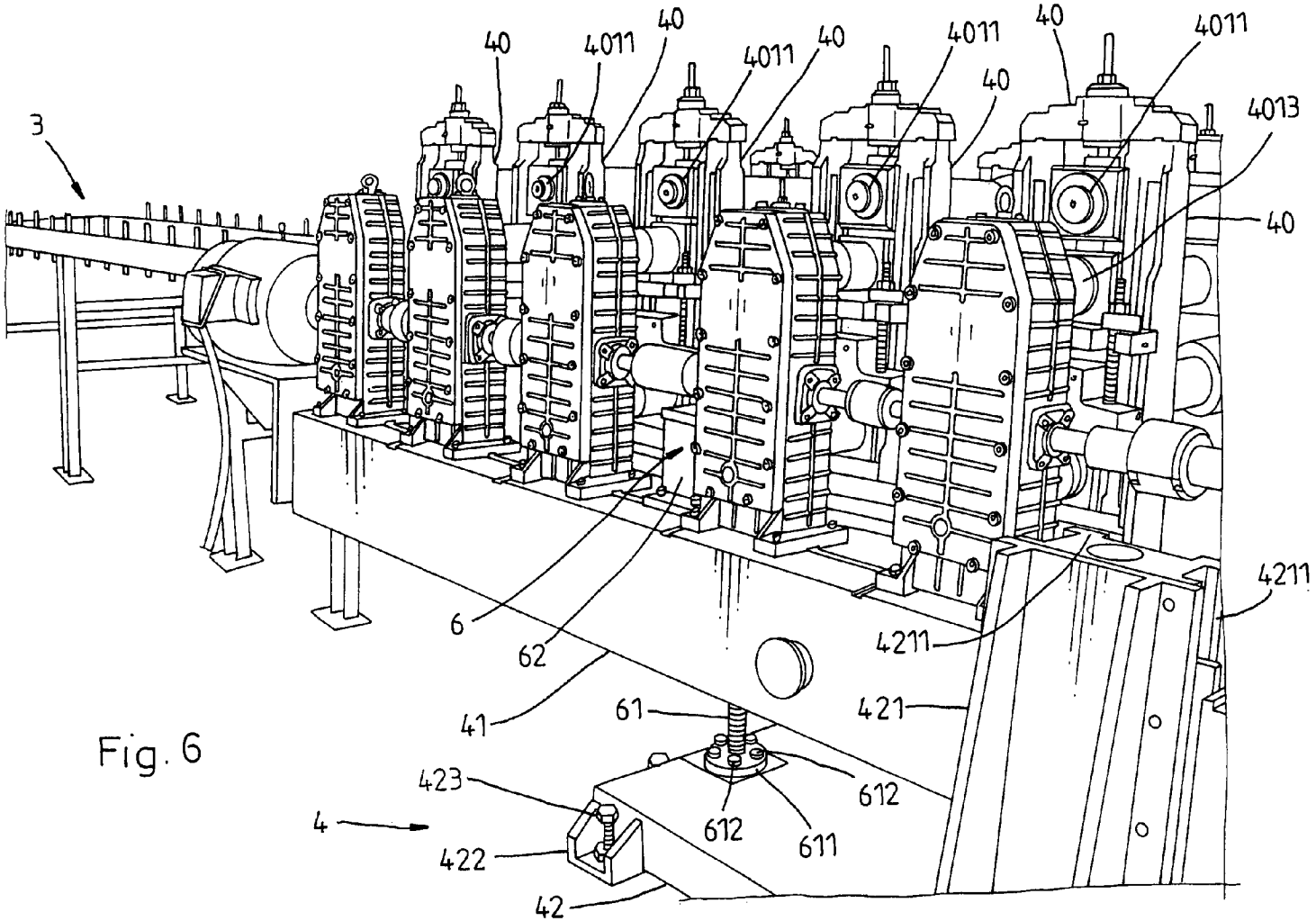
FIG. 6 corresponds to FIG. 5 when viewed from another angle.
Figure 7:
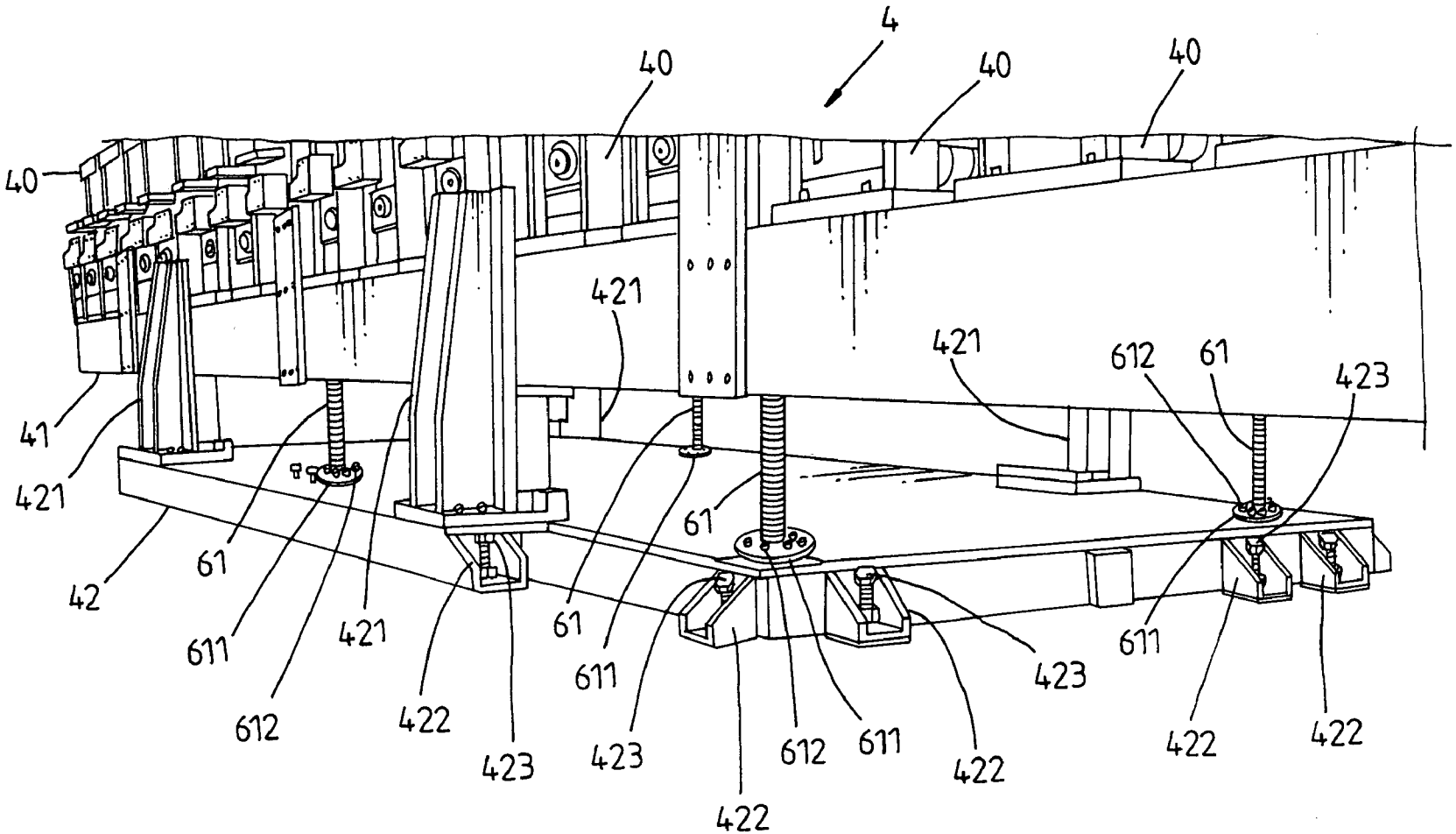
FIG. 7 is a perspective view of a part of FIG. 3, showing the structure of a part of the corrugated sheet forming unit.
Figure 8:
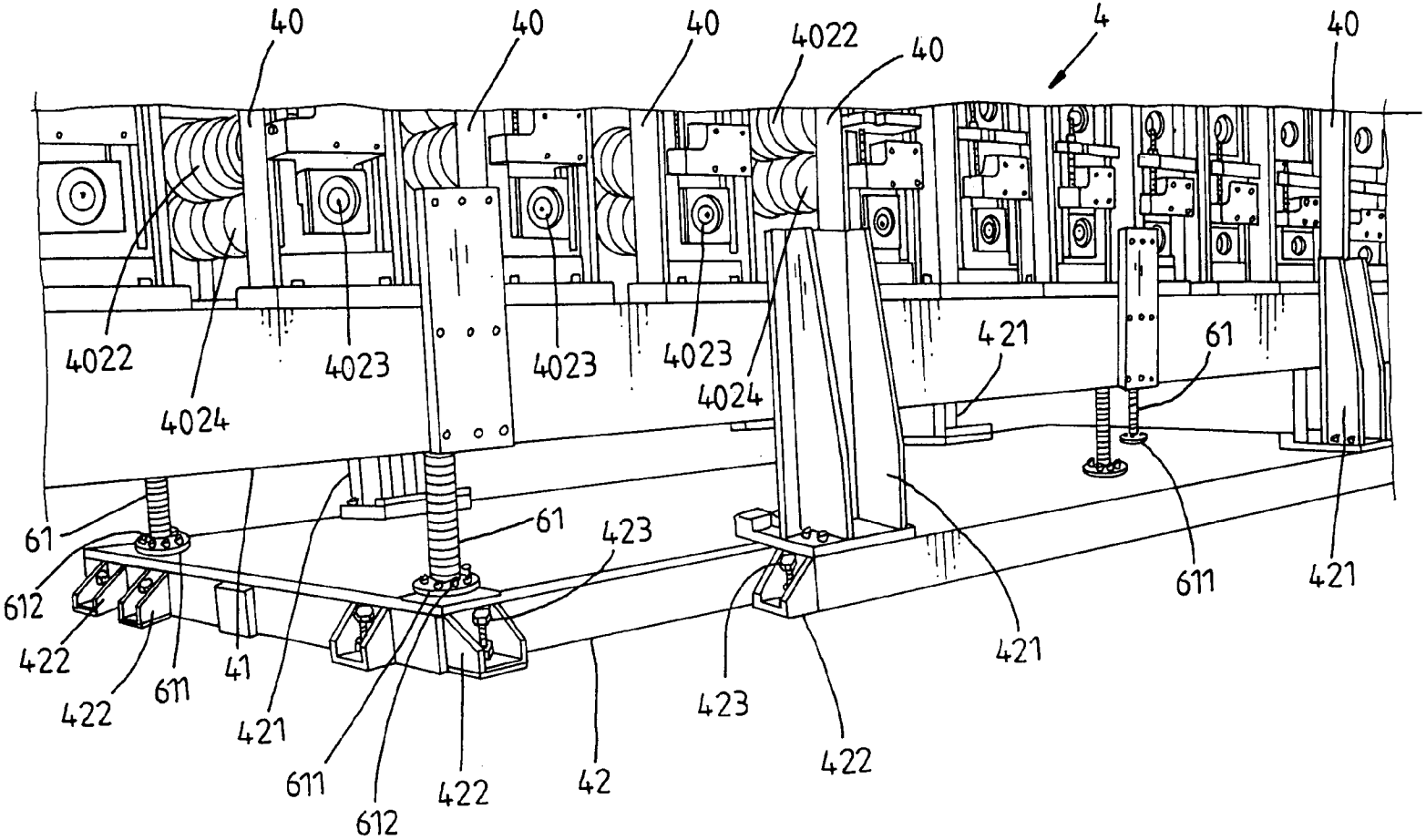
FIG. 8 is a perspective view in an enlarged scale of another part of FIG. 3, showing the structure of another part of the corrugated sheet forming unit.
Figure 9:
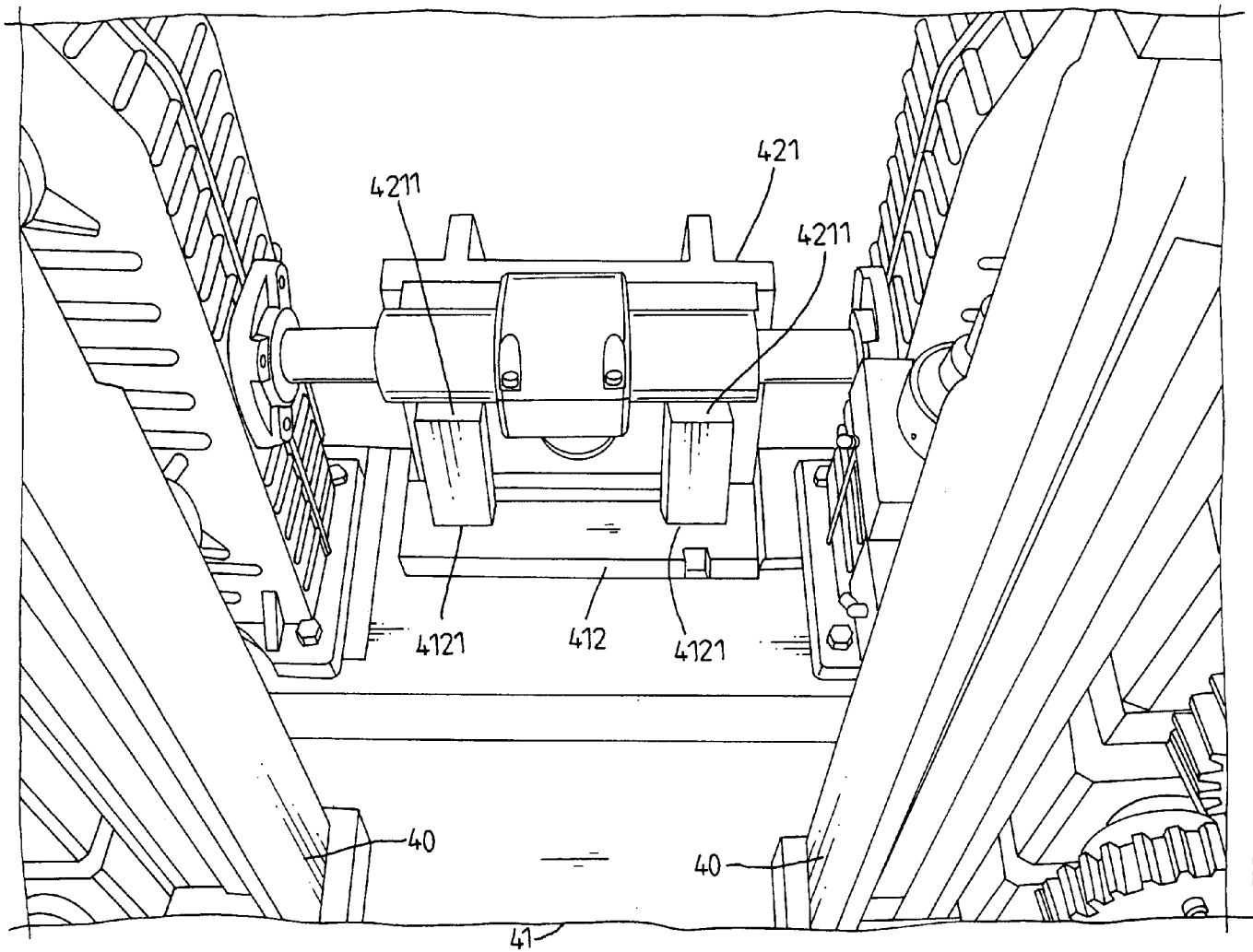
FIG. 9 is a perspective view in an enlarged scale of still another part of FIG. 3, showing the structure of still another part of the corrugated sheet forming unit.
Figure 10:
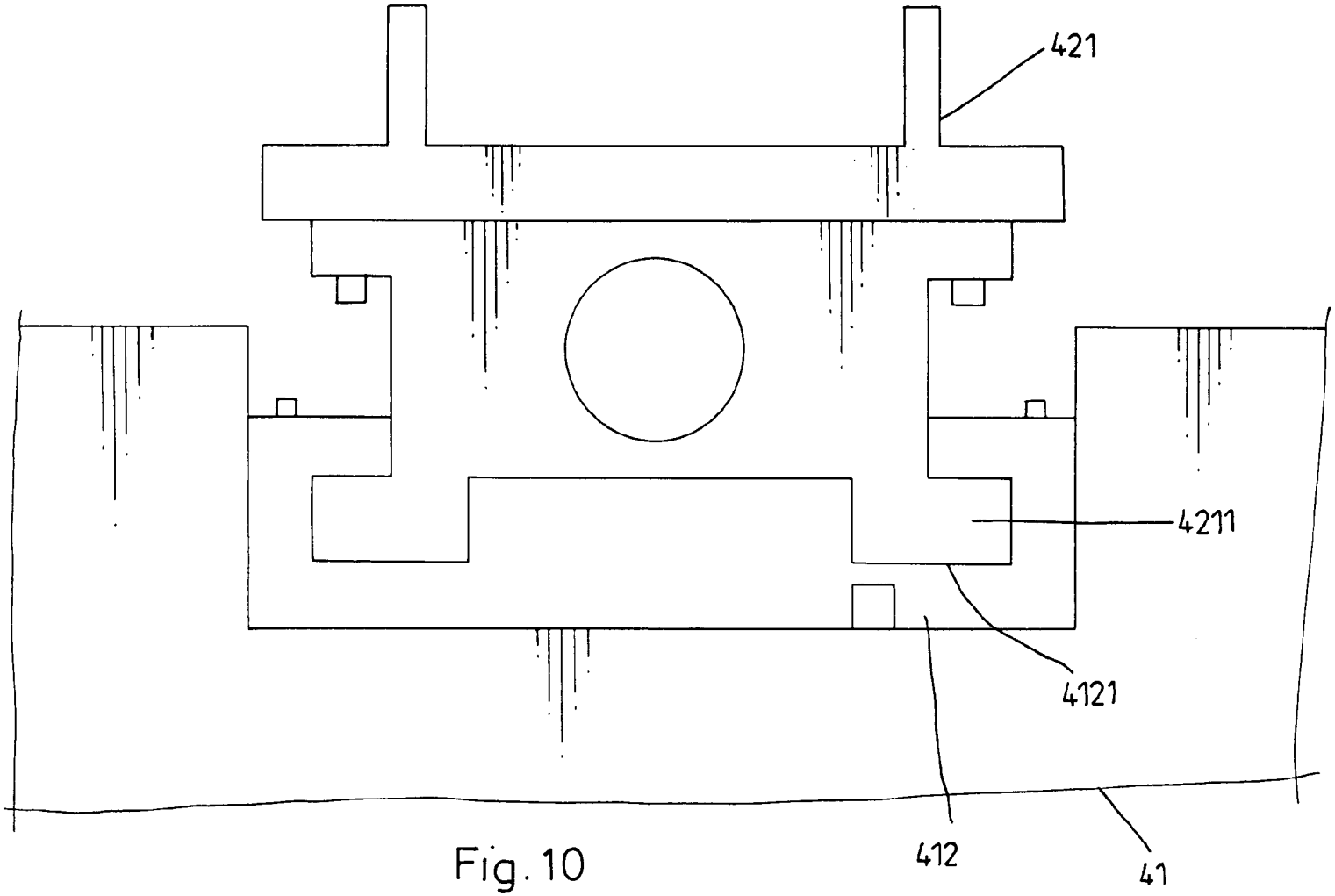
FIG. 10 is an enlarged plain view of a part of the corrugated sheet forming unit according to the present invention.
Figure 11:
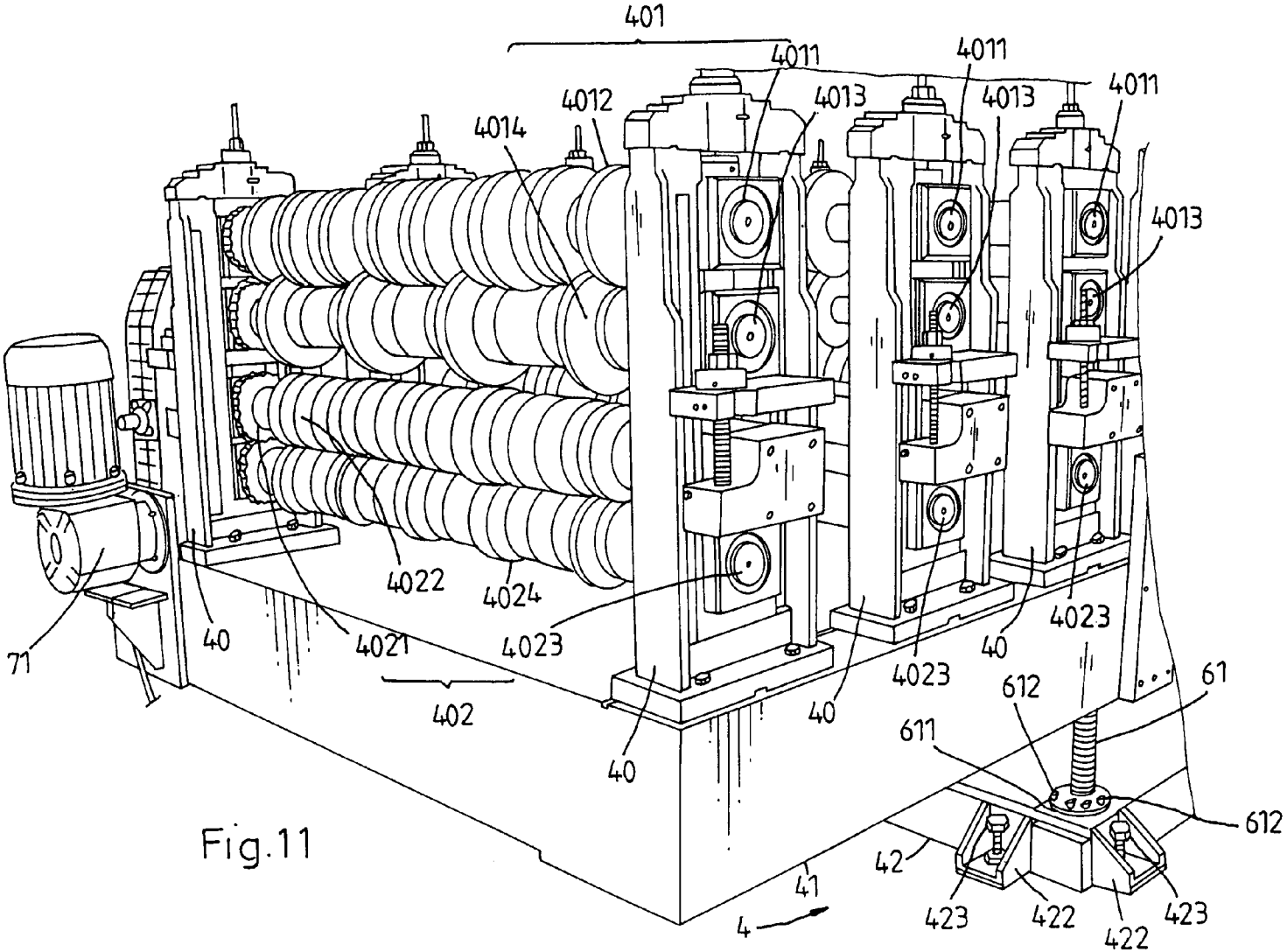
FIG. 11 is another perspective view in an enlarged scale of the corrugated sheet forming unit according to the present invention.
Figure 12:
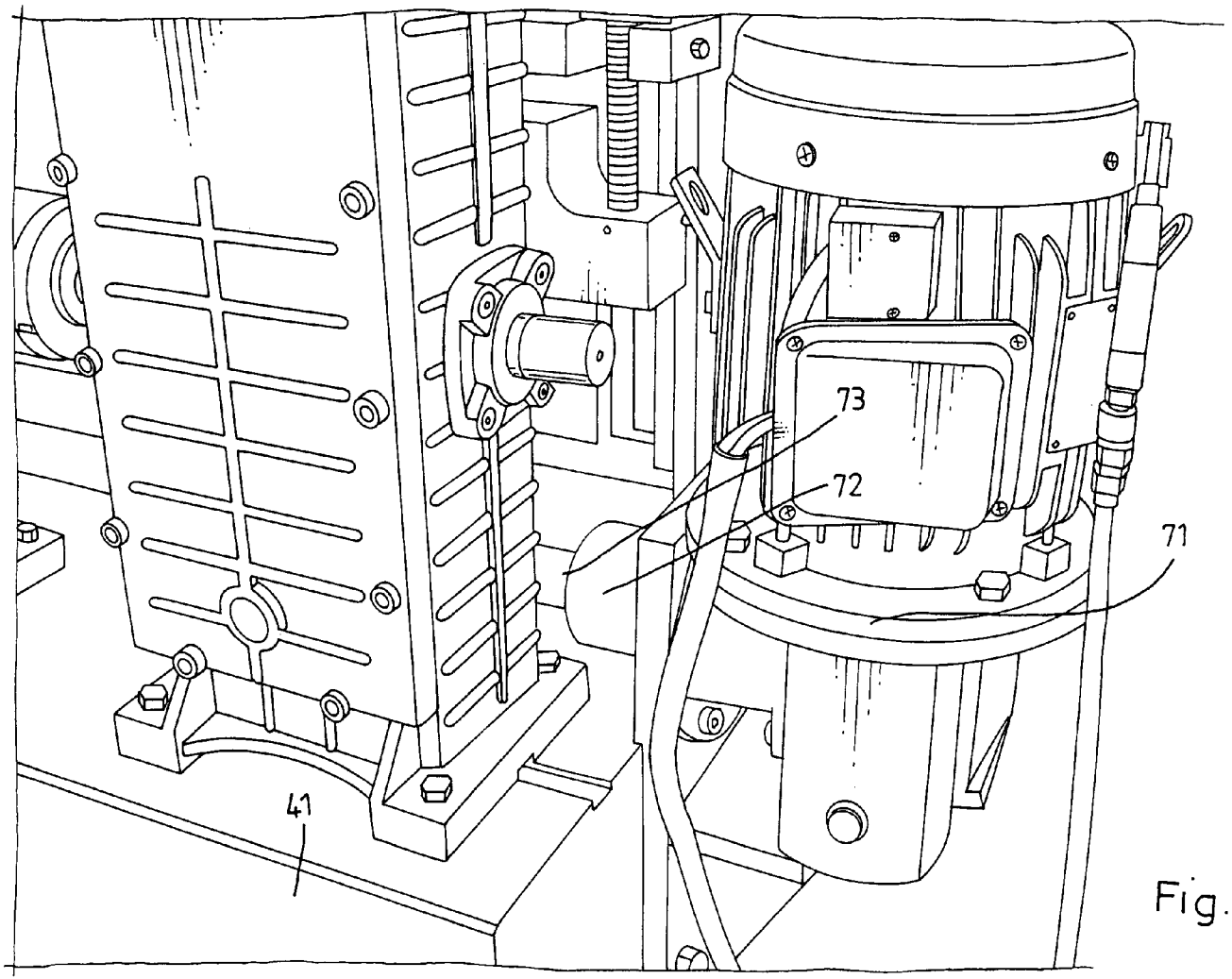
FIG. 12 is a perspective view in an enlarged scale of a part of the corrugated sheet forming unit according to the present invention.
Figure 13:
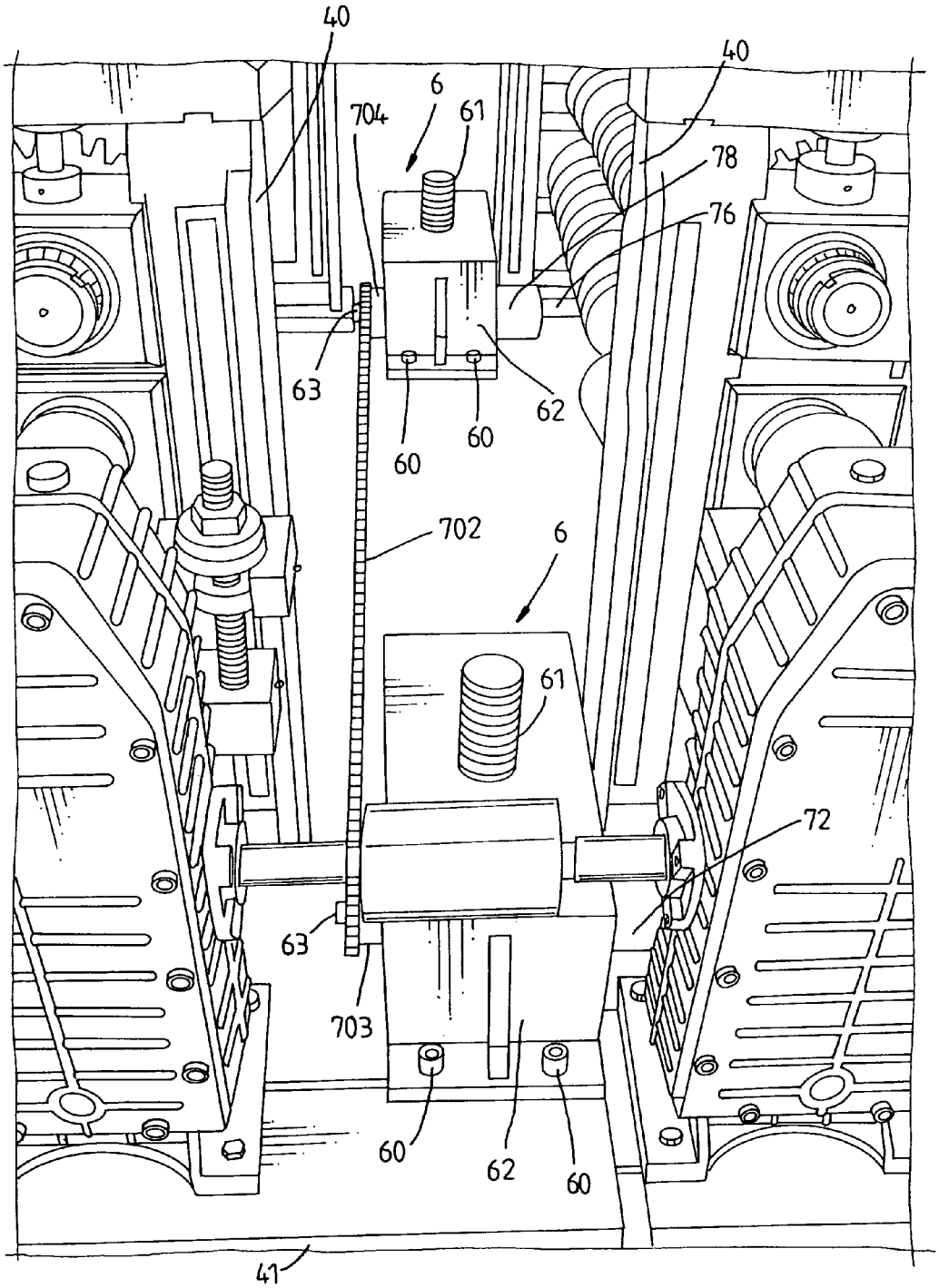
FIG. 13 is a perspective view in an enlarged scale of another part of the corrugated sheet forming unit according to the present invention.

Referring to FIGS. 2~15, a corrugated sheet material making machine in accordance with the present invention is shown comprising:

a material feeder 1 adapted to supply a roll of metal sheet 10 to a cut-off unit;

a cut-off unit 2 adapted to cut off the metal sheet 10 received from the material feeder 1 to the desired length and to guide the cut metal sheet material to a conveyer;

a conveyer 3 (see also FIGS. 4~6) adapted to convey the cut metal sheet material to a corrugated sheet forming unit;

a corrugated sheet forming unit 4 adapted to process the plain metal sheet material received from the conveyer 3 into a corrugated sheet; and a receiving unit 5 (see FIGS. 2 and 3) adapted to collect the finished corrugated sheet for further packing and storage.

Referring to FIGS. 4~14, the corrugated sheet forming unit 4 comprises a table 41, pairs of roller holders 40 symmetrically provided at the top side of the table 41, each pair of roller holders 40 supporting at least one first shape forming roller set 401 and one second shape forming roller set 402 (see FIG. 11) for selectively ramming a plain sheet material into a different corrugated sheet. The first shape forming roller set 401 comprises an upper roller shaft 4011, an upper shape forming roller 4012, a lower roller shaft 4013, and a lower shape forming roller 4014. The second shape forming roller set 402 comprises an upper roller shaft 4021, an upper shape forming roller 40122, a lower roller shaft 4023, and a lower shape forming roller 4024. The upper shape forming roller 4012 and lower shape forming roller 4014 of the first shape forming roller set 401 differ from the upper shape forming roller 4022 and lower shape forming roller 4024 of the second shape forming roller set 402 in shape so that the operator can control the machine to selectively move the first shape forming roller set 401 or the second shape forming roller set 402 to process the plain sheet material into a corrugated sheet subject to the desired pattern. The corrugated sheet forming unit 4 further comprises a plurality of lifters 6 (see FIG. 13). Each lifter 6 comprises a vertical screw rod 61, a movable block 62 mounted on and vertically movable along the vertical screw rod 61, a transmission gear set (not shown), and a driving shaft 63 (see FIG. 14). Rotating the driving shaft 63 clockwise or counter-clockwise causes the transmission gear set to move the movable block 62 upwards/downwards along the vertical screw rod 61.

The main features of the present invention are outlined hereinafter.

The table 41 of the corrugated sheet forming unit 4 is fastened to the movable blocks 62 of the lifters 6 with fastening devices 60. The screw rods 61 of the lifters 6 are respectively threaded through the table 41, each having a bottom end suspending below the table 41 and fixedly mounted with a respective locating block 611, which is fixedly fastened to a fixed base frame 42. Therefore, when rotating the driving shafts 63 of the lifters 6 clockwise or counter-clockwise, the table 41 is moved with the movable blocks 62 of the lifters 6 upwards/downwards along the vertical screw rods 61 of the lifters 6 to the desired elevation (see FIGS. 5~8). Further, a plurality of vertical sliding blocks 412 are fixedly symmetrically provided the table 41 at the left and right sides (see FIGS. 5~10). Each vertical sliding block 412 has a sliding groove 4121. The base frame 42 comprises a plurality of vertical tracks 421 symmetrically arranged at two sides. The tracks 421 each have a rail 4211 respectively coupled to the sliding grooves 4121 of the vertical sliding blocks 412 of the table 41 for guiding vertical movement of the table 41 relative to the base frame 42 smoothly between a first position (the upper position) and a second position (the lower position). When lifted the table 41 to the first position, the conveyer 3 is operated to convey a cut metal sheet material to the corrugated sheet forming unit 4 for processing by the first shape forming roller sets 401 at the roller holders 40. On the contrary, when lifted the table 41 to the second position, the conveyer 3 is operated to convey a cut metal sheet material to the corrugated sheet forming unit 4 for processing by the second shape forming roller sets 402 at the roller holders 40.

Figure 14:
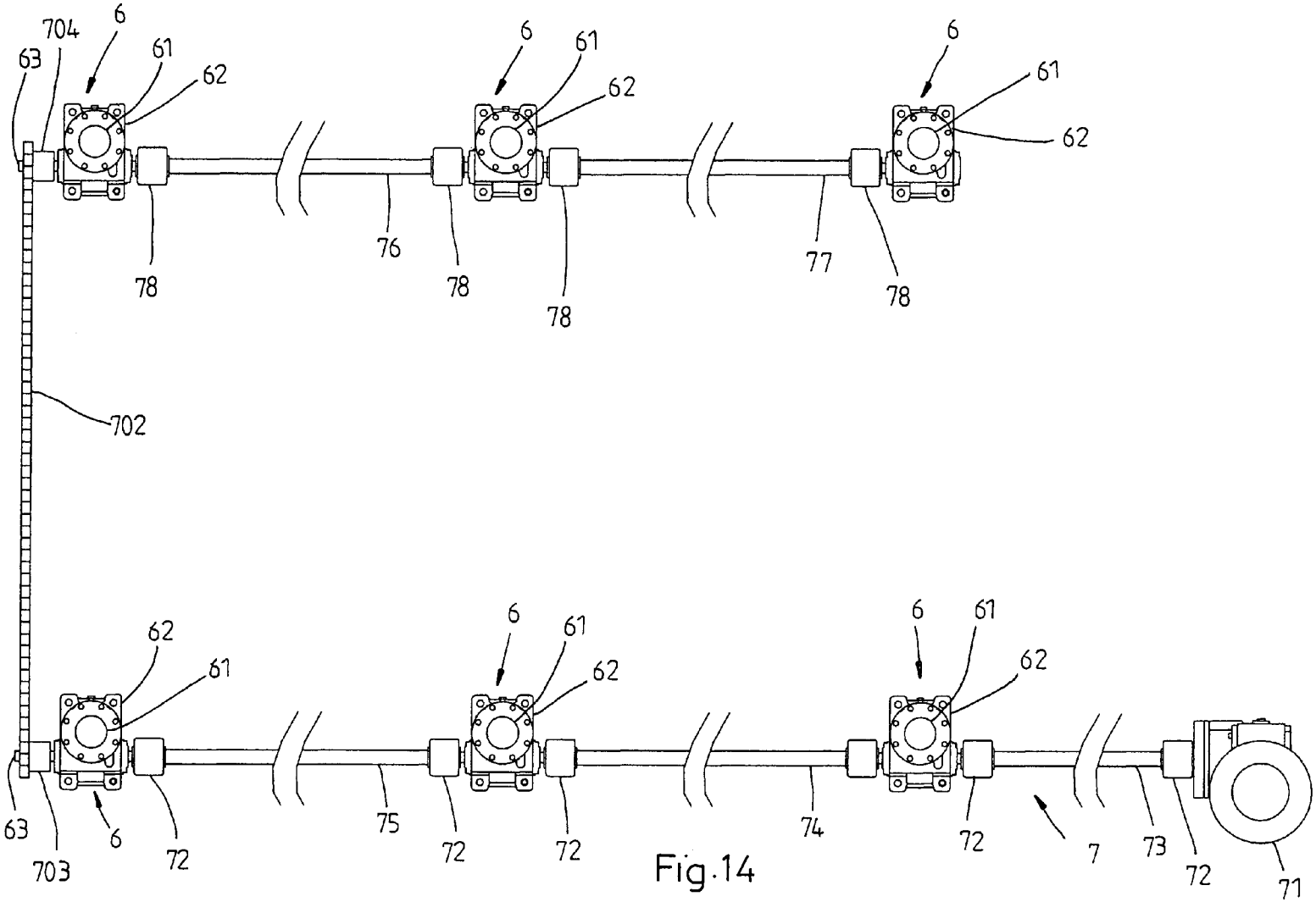
FIG. 14 is a schematic top view showing the arrangement of the driving mechanism and the lifters in the corrugated sheet forming unit according to the present invention.

Referring to FIG. 14, a driving mechanism 7 is provided for driving the driving shafts 63 of the lifters 60. The driving mechanism 7 comprises a motor 71 mounted in the table 41 at one side, a plurality of couplings 72 and transmission shafts 73,74,75 adapted to couple the driving shafts 63 of the lifters 6 at one side, namely, the left side of the table 41 to the motor 71, a plurality of couplings 78 and transmission shafts 76,77 adapted to couple the driving shafts 63 of the lifters 6 at the other side, namely, the right side of the table 41 to one another, and a chain 702 and two chain wheels 703,704 adapted to couple the driving shaft 63 of the last lifter 6 at the left side of the table 41 to the driving shaft 63 of the first lifter 6 at the right side of the table 41. Therefore, when starting the motor 71, the transmission shafts 73,74,75 and the driving shafts 63 of the lifters 6 at the left side of the table 41 are rotated with the motor 71, and the chain 702 is then rotated with the chain wheels 703,704 to further rotate the transmission shafts 76,77 and then the driving shafts 63 of the lifters 6 at the right side of the table 41.

Figure 15:
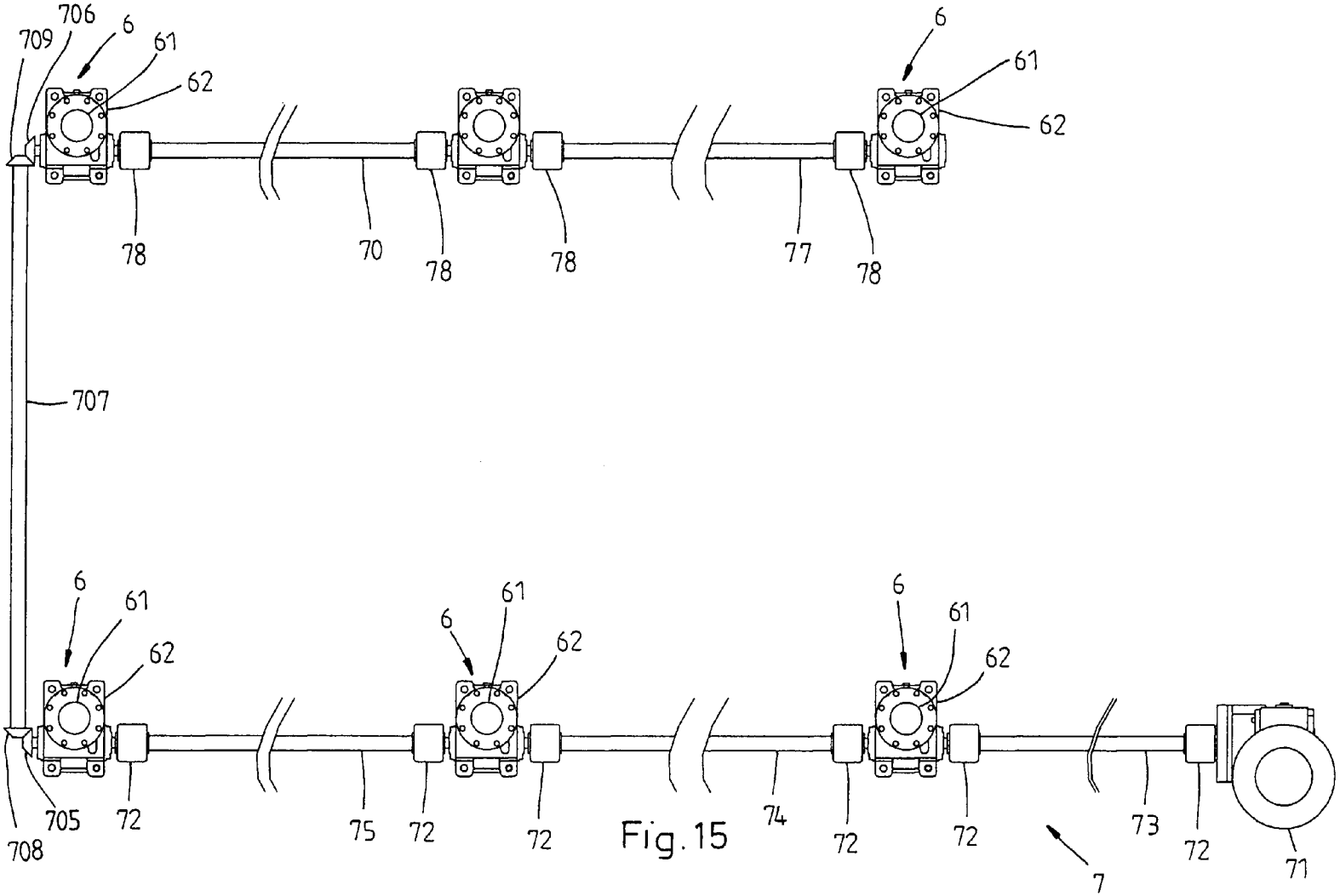
FIG. 15 is a schematic top view showing an alternate form of the arrangement of the driving mechanism and the lifters in the corrugated sheet forming unit according to the present invention.

FIG. 15 shows an alternate form of the driving mechanism 7. This embodiment is substantially similar to the embodiment shown in FIG. 14 with the exception of the use of two bevel gears 705,706 to substitute for the aforesaid chain wheels 703,704, and a transmission shaft 707 with end bevel gears 708,709 to substitute for the aforesaid chain 702. The bevel gears 708,709 at the ends of the transmission shaft 707 are respectively meshed with the bevel gear 705 at the last lifter 6 at the left side of the table 41 and the bevel gear 706 at the first lifter 6 at the right side of the table 41.

Further, the base frame 42 has a plurality of mounting blocks 422 spaced around the four sides for fastening to the floor or a suitable place inside the factory with fastening devices 423.

As indicated above, the invention has the following advantages:

1. The table 41 of the corrugated sheet forming unit 4 is vertically movable so that the operator can select the first shape forming roller sets 401 or second shape forming roller sets 402 to process the supplied plain sheet material to the desired corrugated sheet, i.e., the corrugated sheet forming unit 4 is practical for processing plain metal sheets into two different shapes of corrugated sheets.

2. The table 41 of the corrugated sheet forming unit 4 is vertically movable to fit the elevation of the conveyer 3 and the receiving unit 5.

3. The roller holders 40 of the corrugated sheet forming unit 4 each supporting at least one first shape forming roller set 401 and one second shape forming roller set 402 for processing plain sheet materials into different shapes of corrugated sheets, saving much factory space.

Although particular embodiments of the present invention have been described in detailed for purposes of illustration, various modifications and enhancements may be made without departing from the spirit and scope of the invention. Accordingly, the invention is not to be limited except as by the appended claims.

What is claimed is:

1. A corrugated sheet forming unit used in a corrugated sheet material making machine, said corrugated sheet material making machine comprising:

a material feeder adapted to supply a roll of metal sheet to a cut-off unit;

a cut-off unit adapted to cut off the metal sheet received from said material feeder to the desired length and to guide the cut metal sheet material to a conveyer;

a conveyer adapted to convey the cut metal sheet material from said cut-off unit to said corrugated sheet forming unit;

said corrugated sheet forming unit adapted to process the cut metal sheet material received from said conveyer into a corrugated sheet; and a receiving unit adapted to collect the finished corrugated sheet for further packing and storage;

said corrugated sheet forming unit comprising a table, pairs of roller holders symmetrically provided at said table, each pair of said roller holders supporting at least one first shape forming roller set and one second shape forming roller set disposed directly below the first shape forming roller set for selectively ramming a plain sheet material into a different corrugated sheet, said first shape forming roller set comprising an upper roller shaft, an upper shape forming roller, a lower roller shaft, and a lower shape forming roller, said second shape forming roller set comprising an upper roller shaft, an upper shape forming roller, a lower roller shaft, and a lower shape forming roller, a plurality of lifters symmetrically arranged in line at left and right sides of said table, said lifters each comprising a vertical screw rod, a movable block mounted on and vertically movable along said vertical screw rod, a transmission gear set, and a driving shaft for driving said transmission gear set to move said movable block upwards/downwards along said vertical screw rod;

wherein said table of said corrugated sheet forming unit is fastened to the movable blocks of said lifters with fastening devices; said screw rods of said lifters are respectively threaded through said table, each having a bottom end suspending below said table and fixedly mounted with a respective locating block, which is fixedly fastened to a fixed base frame for enabling said table to be moved with the movable blocks of said lifters upwards/downwards along the vertical screw rods of said lifters relative to said base frame to the desired elevation when the driving shafts of said lifters are rotated clockwise/counter-clockwise, said table comprising a plurality of vertical sliding blocks symmetrically disposed at two opposite lateral sides and respectively coupled to a respective vertical track at said base frame for guiding vertical movement of said table relative to said base frame.

2. The corrugated sheet forming unit as claimed in claim 1, further comprising a driving mechanism adapted to drive the transmission shafts of said lifters, said driving mechanism comprising a motor mounted in said table at one side, a plurality of couplings and transmission shafts that couple the driving shafts of the lifters at the left side of said table to said motor, a plurality of couplings and transmission shafts adapted that couple the driving shafts of the lifters at the right side of said table to one another, and a chain and two chain wheels that couple the driving shaft of one lifter at the left side of said table to the driving shaft of one lifter at the right side of said table.

* * * * *